US011535448B2

(12) United States Patent
Rimsa

(10) Patent No.: US 11,535,448 B2
(45) **Date of Patent: *Dec. 27, 2022**

(54) SCISSORS-TYPE LIFTER FOR INTERMEDIATE REFUSE COLLECTION CONTAINER

(71) Applicant: Perkins Manufacturing Co., Bolingbrook, IL (US)

(72) Inventor: James Rimsa, Joliet, IL (US)

(73) Assignee: PERKINS MANUFACTURING CO., Bolingbrook, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/530,732

(22) Filed: Nov. 19, 2021

(65) Prior Publication Data

US 2022/0073274 A1 Mar. 10, 2022

Related U.S. Application Data

(63) Continuation of application No. 16/941,645, filed on Jul. 29, 2020, now Pat. No. 11,192,717.
(Continued)

(51) Int. Cl.

| | |
|---|---|
| ***B65F 1/14*** | (2006.01) |
| ***B65F 1/12*** | (2006.01) |
| ***B65F 3/02*** | (2006.01) |

(52) U.S. Cl.
CPC ..... *B65F 1/1452* (2013.01); *B65F 1/12* (2013.01); *B65F 2003/023* (2013.01); *B65F 2003/0276* (2013.01)

(58) Field of Classification Search
CPC ..... B65F 1/12; B65F 1/1452; B65F 1/122; B65F 2003/023; B65F 2003/027; B65F 3/041; B65F 3/046
See application file for complete search history.

(56) References Cited

U.S. PATENT DOCUMENTS 3,902,616 A * 9/1975 Santic ..... B66F 7/08 414/420
4,773,812 A 9/1988 Bayne
(Continued)

OTHER PUBLICATIONS

Perkins PAC Brochure—2011, 2 pages.

*Primary Examiner* — Kaitlin S Joerger
(74) *Attorney, Agent, or Firm* — Cook Alex Ltd.

(57) ABSTRACT

A cart lifter assembly is provided that is adapted to be mounted to an intermediate refuse collection container that includes a scissors-type extension assembly for moving the lifter between a first/retracted and a second/extended position. The scissors extension assembly further comprises an elongated channel member configured to be secured to the wall of the intermediate container; a mounting block slidably received in the elongated channel member; first second, third and fourth scissor arms; and a bracket configured to be fixedly mounted to the wall of the intermediate container in spaced relationship to the elongated channel member. A rotary actuator is secured to the bracket and has a rotatable shaft extending from opposite ends thereof, for moving the lifter relative to the intermediate container between the first/retracted position and the second/extended position, with one end of the second scissor arm being removably secured to the rotatable shaft.

20 Claims, 11 Drawing Sheets

Related U.S. Application Data

(60) Provisional application No. 62/898,673, filed on Sep. 11, 2019.

(56) References Cited

U.S. PATENT DOCUMENTS

| | | | | | |
|---|---|---|---|---|---|
| 5,007,786 | A * | 4/1991 | Bingman | B65F 3/001 | 414/409 |
| 5,484,245 | A | 1/1996 | Zopf | | |
| 5,607,277 | A | 3/1997 | Zopf | | |
| 5,639,201 | A | 6/1997 | Curotto | | |
| 5,769,592 | A * | 6/1998 | Christenson | B65F 3/046 | 414/408 |
| 5,797,715 | A | 8/1998 | Christenson | | |
| 5,938,394 | A | 8/1999 | Christenson | | |
| 6,139,244 | A | 10/2000 | VanRaden | | |
| 6,929,441 | B2 | 8/2005 | Arrez et al. | | |
| 7,273,340 | B2 * | 9/2007 | Arrez | B65F 3/041 | 414/421 |
| 7,806,645 | B2 * | 10/2010 | Arrez | B65F 3/046 | 414/408 |
| 7,871,233 | B2 * | 1/2011 | Arrez | B65F 3/041 | 414/408 |
| 10,035,648 | B2 | 7/2018 | Haddick et al. | | |
| 2005/0095097 | A1 | 5/2005 | Arrez et al. | | |
| 2007/0243050 | A1 * | 10/2007 | Arrez | B65G 65/23 | 414/618 |
| 2010/0322749 | A1 * | 12/2010 | Rowland | B65F 3/041 | 414/408 |
| 2011/0038697 | A1 * | 2/2011 | Arrez | B65F 1/122 | 414/408 |
| 2018/0037408 | A1 | 2/2018 | Rimsa | | |
| 2020/0346855 | A1 * | 11/2020 | Rocholl | B65F 3/041 | |
| 2020/0346859 | A1 * | 11/2020 | Buege | B65F 3/048 | |

* cited by examiner

SCISSORS-TYPE LIFTER FOR INTERMEDIATE REFUSE COLLECTION CONTAINER

The present disclosure relates to a refuse container or cart lifter. The lifter may be mounted to a stationary or mobile container, compacting container, side loading refuse collection vehicle or other type of receptacle. The lifter is particularly adapted to be mounted to a side face of a larger front-load refuse receptacle that is removably mounted to, e.g., a pair of forks that carry the larger refuse receptacle in front of a refuse collection vehicle, and invert the larger refuse receptacle to dump its contents into a body or chamber located rearward of the cab of the vehicle.

BACKGROUND OF THE INVENTION

Front load refuse collection vehicles are in wide use in large-scale residential refuse collection. A front load refuse collection vehicle typically has a front cab, a large refuse compartment behind the cab, and a pair of hydraulic-powered lift forks extending in front of the vehicle that are adapted to be inserted into corresponding slots or sleeves associated with an intermediate size portable refuse collection container. The forks are able to lift the refuse container over the front of the vehicle and invert the container to dump its contents into the refuse compartment or body located behind the cab.

For residential and small-scale refuse collection, the collection container often is carried in front of the collection vehicle as it moves along the street. The contents of smaller residential collection carts are first dumped into the intermediate collection container to fill the intermediate container, and the intermediate container is then inverted to dump its contents into a larger collection bin behind the vehicle cab.

Typically, a hydraulic cart lifter is mounted to the intermediate collection container to invert the residential collection cart to dump its contents into the intermediate container. Hydraulic lifters also have been mounted to the intermediate collection container in a manner so that the lifter can be moved laterally relative to the intermediate container into engagement with the residential refuse cart for curb-side collection, rather than requiring the operator to move the refuse receptacle to the lifter. U.S. Pat. Nos. 5,484,245; 5,607,277; 5,639,201; 5,797,715; 5,938,394; and 6,139,244, all of which are hereby incorporated by reference, illustrate such arrangements.

A side loading system having a scissors-type mechanism for moving the cart lifter laterally relative to the intermediate container is shown in the U.S. Pub. No. 2011/0038697, herein incorporated by reference. The scissors mechanism in this published application includes a hydraulic piston/cylinder to extend and retract the cart lifter. When retracted, the cylinder is nearly in line with the scissor arms, so that the cylinder does not strongly hold the scissors mechanism in the retracted position, which is needed for storage of the lifter for transportation. In addition, the rate of travel when the scissors arms are initially extended is higher than the subsequent rate of travel, resulting in an initial jumpy or jerky movement of the cart lifter. The jumpy, jerky movement degrades the operation of the system, as a collection cart, if too close to the curb, can be knocked over before the cart grabbing mechanism secures the collection cart to the cart lifter. Controlling the initial speed of the scissors mechanism by simply slowing the rate of extension of the piston/cylinder, slows the whole movement of the scissors, thus reducing the efficiency of the system. By way of the present application these shortcomings of the prior art are addressed.

SUMMARY

In accordance with a first aspect of the disclosure, a lifter assembly for emptying a curbside refuse collection cart into an intermediate container is provided. The lifter assembly includes a cart lifter comprising a frame, a cart grabber pivotably mounted to the frame, opposed grabber arms pivotably mounted to the cart grabber, a first actuator mounted to the cart grabber for moving the grabber arms relative to the cart grabber between a first extended/open position and a second closed position, and a second actuator for moving the cart grabber relative to the frame between a first upright position and a second inverted/dumping position.

The lifter assembly additionally includes a scissors-type extension assembly for moving the lifter between a first/retracted position adjacent a wall of the intermediate container and a second/extended position spaced away from the wall of the intermediate container. The scissors extension assembly further comprises: i) an elongated channel member configured to be secured to the wall of the intermediate container; ii) a mounting block slidably received in the elongated channel member; iii) a first scissor arm having first and second ends, the first end being pivotably secured to the mounting block; iv) a bracket configured to be fixedly mounted to the wall of the intermediate container in spaced relationship to the elongated channel member; v) a second scissor arm having first and second ends, the first end being secured for pivotable movement relative to the bracket, an intermediate portion of the first scissor arm being pivotably secured to an intermediate portion of the second pivot arm; vi) a third scissor arm having first and second ends, the first end being pivotably connected to the second end of the first scissors arm and the second end being pivotably connected to the frame of the lifter; vii) a fourth scissor arm having first and second ends, the first end being pivotably connected to the second end of the second scissors arm and the second end being pivotably connected to the frame of the lifter. A third actuator comprising a rotary actuator is secured to the bracket and has a rotatable shaft extending from opposite ends thereof, for moving the lifter relative to the intermediate container between the first/retracted position and the second/extended position, with the first end of the second scissor arm being secured to the rotatable shaft.

In a second aspect, each grabber arm of the lifter assembly further comprises a hub for pivotably mounting the grabber arm to the cart grabber and an elongated blade. The elongated blade includes an inner, resilient gripping layer secured to a rigid support, and the rigid support comprises a plurality of members layered one on top of the other, each secured on a first end to the hub and being of increasing length, with the member directly supporting the gripping layer having a length substantially equal to the length of the gripping layer. Preferably, the rigid support comprises a first member having a length approximately one-third the length of the gripping layer, a second member approximately two-thirds the length of the gripping layer, and a third member approximately the same length as the gripping layer.

In a third aspect, the second actuator of the lifter assembly is mounted to the frame and comprises a rotary actuator having a rotatable shaft extending from opposite ends thereof. The frame further comprises opposed side members, each side member having a generally circular aperture through which the ends of the shaft extend, with a slot connecting the aperture to an edge of the frame. A removable plate member is provided that is sized to substantially fill the slot, which is secured to the side member.

In a fourth aspect, the elongated channel of the lifter assembly further comprises a base member, with first and second elongated guide members removably secured with the base member to the wall of the intermediate container. Preferably, each guide member further comprises an elongated low-friction slide block and an elongated cap, with the cap having a width relative to the slide block sufficient to create a lip for maintaining the mounting block slidably received in the elongated channel member.

In a fifth aspect, the first end of the second scissor arm of the lifter assembly is removably secured to the shaft of the third actuator. Preferably, the second scissor arm comprises a reinforcement plate welded to the second scissor arm at its first end, and the first end of the second scissor arm is secured to the shaft of the third actuator by an adapter plate removably attached to the reinforcement plate.

In a sixth aspect, the slidable mounting block of the lifter assembly comprises a first member to which the first end of the first scissor arm is pivotably mounted and a second member slidably received in the channel member. Preferably, the second member comprises a framework having opposed edges, with each of the opposed edges having a low friction slide block removably secured thereto so as to be in face-to-face sliding relationship with a slide block of an adjacent guide member.

Other features and aspects will become apparent upon reference to the accompanying drawings and detailed description.

BRIEF DESCRIPTION OF THE FIGURES OF THE DRAWINGS

FIG. 8*a* is and enlarged exploded perspective view of the cart lifter frame and actuator for moving the cart grabber between a first upright position and a second inverted/dumping position, while FIG. 8*b* is an enlarged perspective view showing the same elements as assembled.

FIG. 11*a* is a partially exploded enlarged perspective view of the slidable mounting block for the first scissor arm showing details as to the portion of the mounting block that is received in the elongated channel member, while FIG. 11*b* is an enlarged perspective view of the slidable mounting block in combination with the elongated channel member.

DETAILED DESCRIPTION

Figure 1:
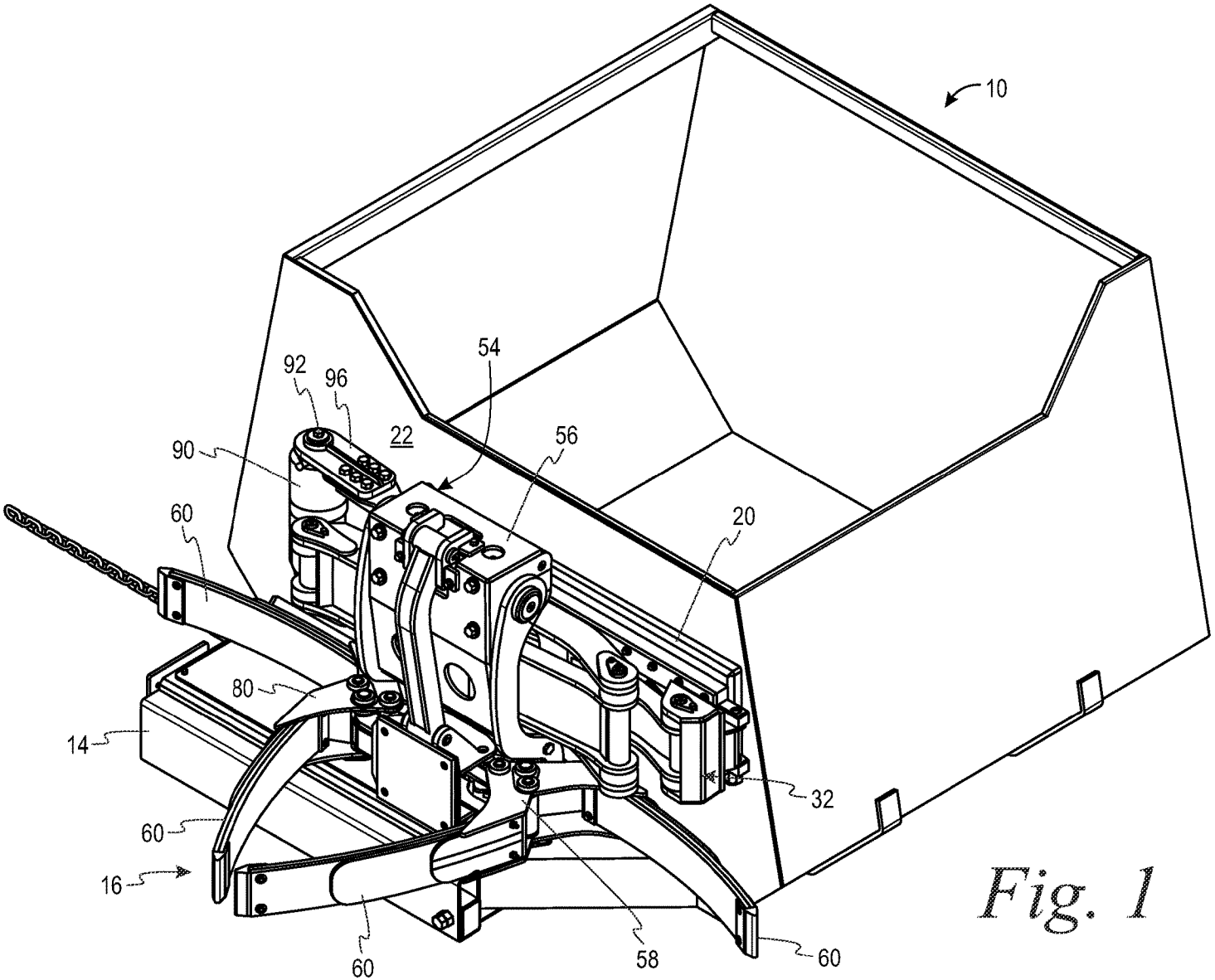
FIG. 1 is a perspective view of a scissors-type lifter assembly according to the present disclosure mounted to a side wall of an intermediate refuse collection container with the scissors mechanism in the retracted position, the cart lifter in the upright position, and the grabber arms in the open and closed positions.
Figure 2:
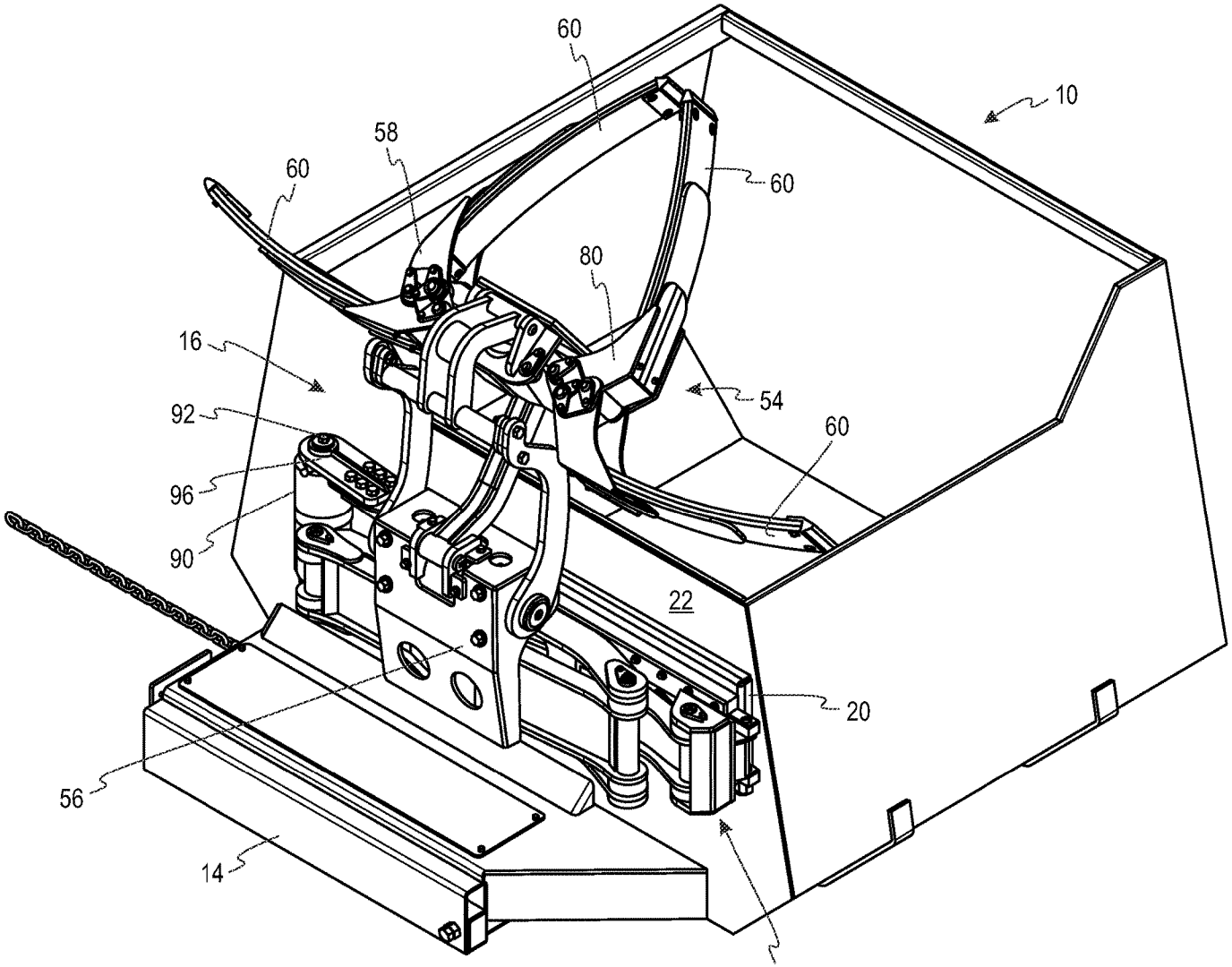
FIG. 2 is a perspective view of the scissors-type lifter assembly of FIG. 1, with the scissors mechanism in the retracted position, the cart lifter in the inverted/dumping position, and the grabber arms in the open and closed positions.
Figure 3:
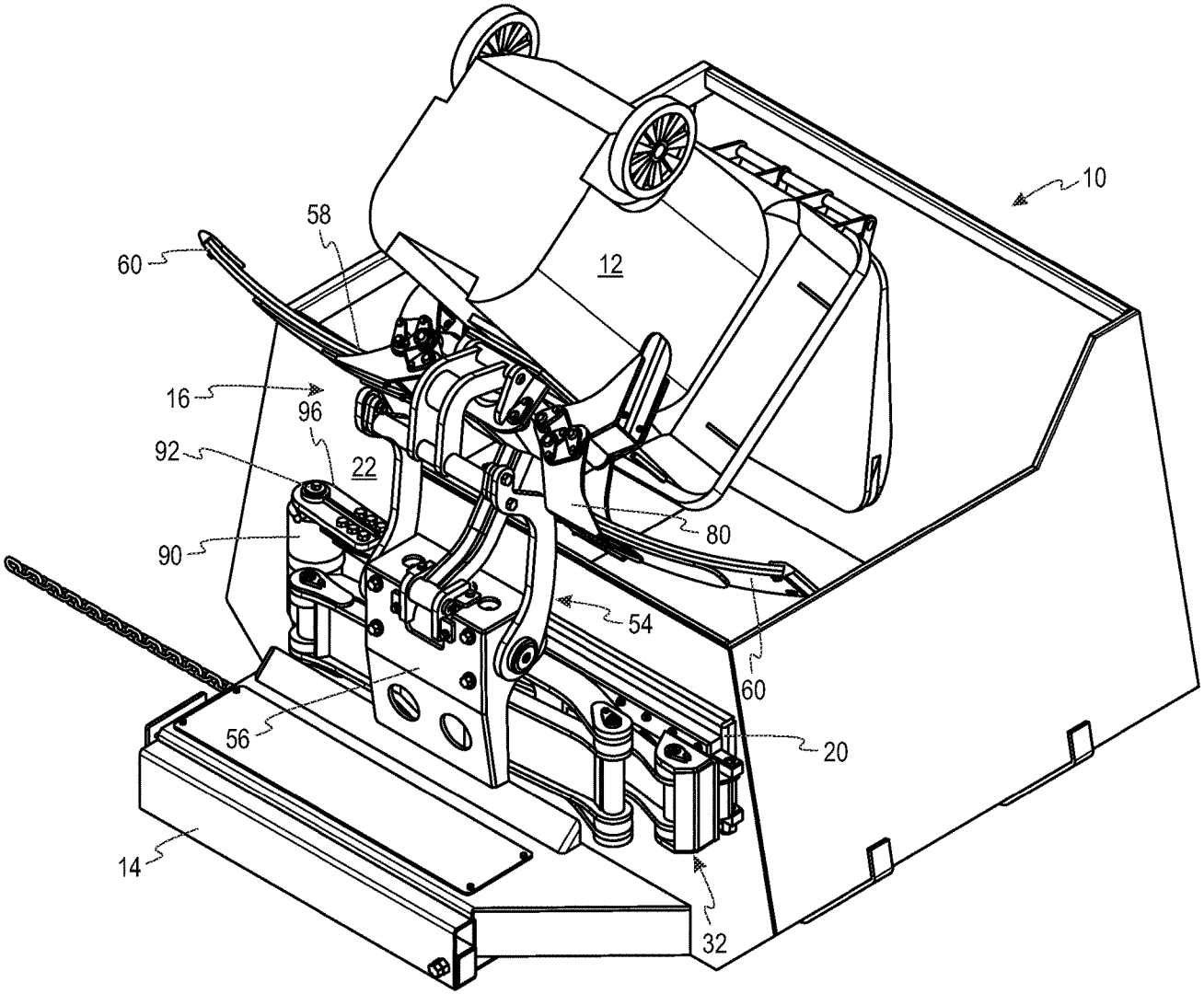
FIG. 3 is similar to FIG. 2, except that a curbside refuse collection cart is shown in combination with the system.
Figure 4:
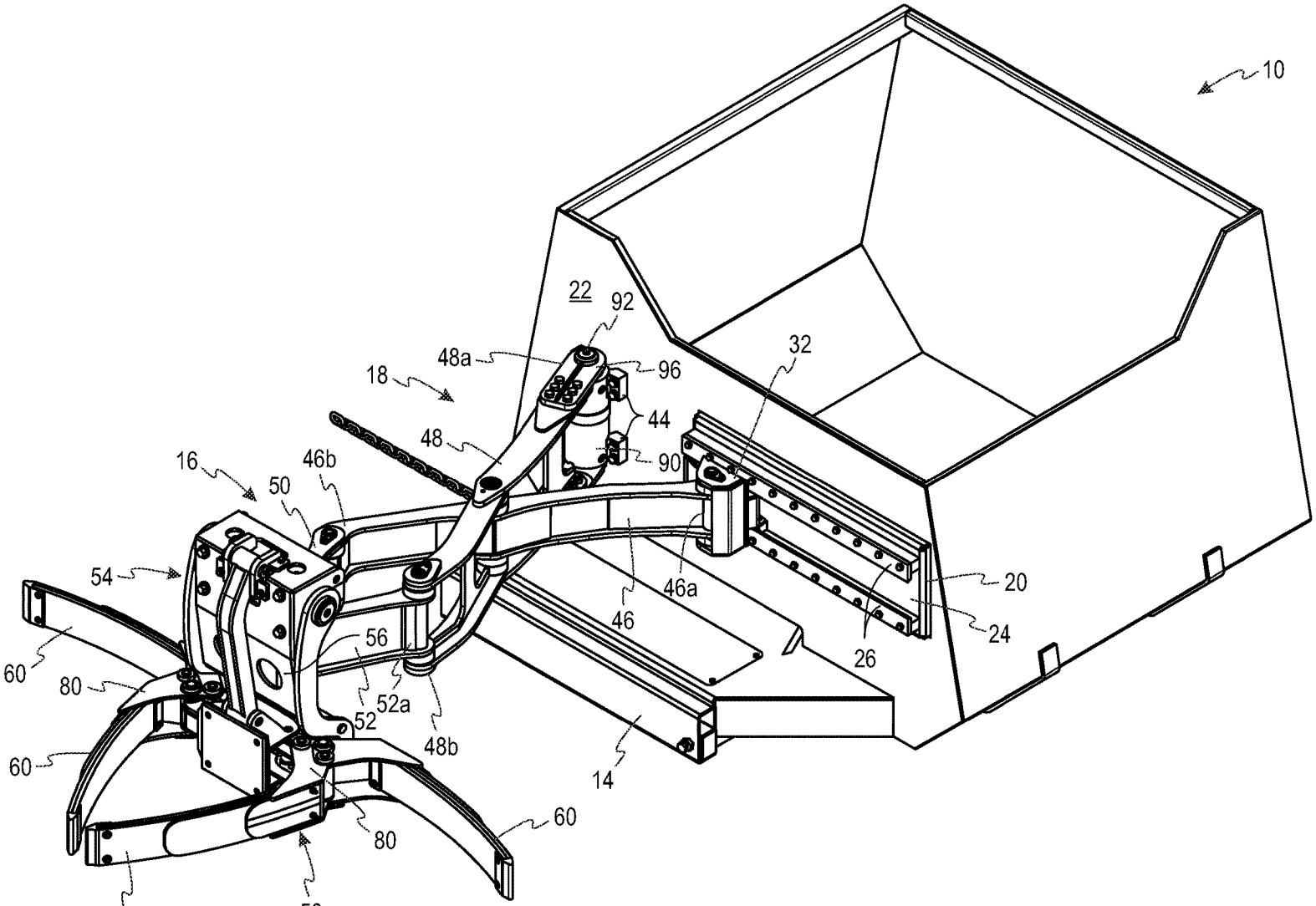
FIG. 4 is a perspective view of a scissors-type lifter assembly of FIG. 1, with the scissors mechanism in the extended position, the cart lifter in the upright position, and the grabber arms in the open and closed positions.

Front load refuse collection vehicles are in wide-spread use in large-scale residential refuse collection. A front load refuse collection vehicle typically has a front cab with a large refuse compartment behind the cab. A pair of hydraulic-powered lift forks extend in front of the truck that are adapted to be inserted into corresponding slots or sleeves associated with an intermediate-size portable refuse collection container, such as the intermediate collection container 10 in FIGS. 1-6. The forks are able to lift the refuse container 10 over the cab of the truck, and invert the container to dump its contents into the refuse compartment or body located behind the cab. Alternatively, the intermediate container may be removably attached to the lift arms of the collection vehicle, as shown in US 2018/0037408 or U.S. Pat. No. 10,035,648, which are incorporated herein by reference.

For residential and small-scale refuse collection, the collection container is often carried in front of the collection vehicle as it moves along the street. The smaller residential curb-side collection carts (such as cart 12 in FIG. 3) are first dumped by a lifter mounted to the intermediate collection container into the intermediate collection container. Then, when filled, the intermediate collection container is inverted to dump its contents into the larger collection bin of the vehicle. The intermediate refuse collection container 10 may include sleeves or channels 14 for receiving the lift forks associated with the refuse collection vehicle, or be removably attached to the lift arms of the collection vehicle, as noted above.

By way of the present disclosure, a container lifter assembly, generally designated 16, is adapted to be mounted to the side wall of the intermediate refuse collection container 10, adjacent to the loading area of the intermediate refuse container 10. The lifter 16 may, alternatively, be mounted to the front wall of the intermediate refuse collection container 16, to a stationary container or compactor, or to the side of the collection vehicle, without departing from the present invention, although mounting to the side wall is preferred for curb-side residential pickup.

Figure 9:
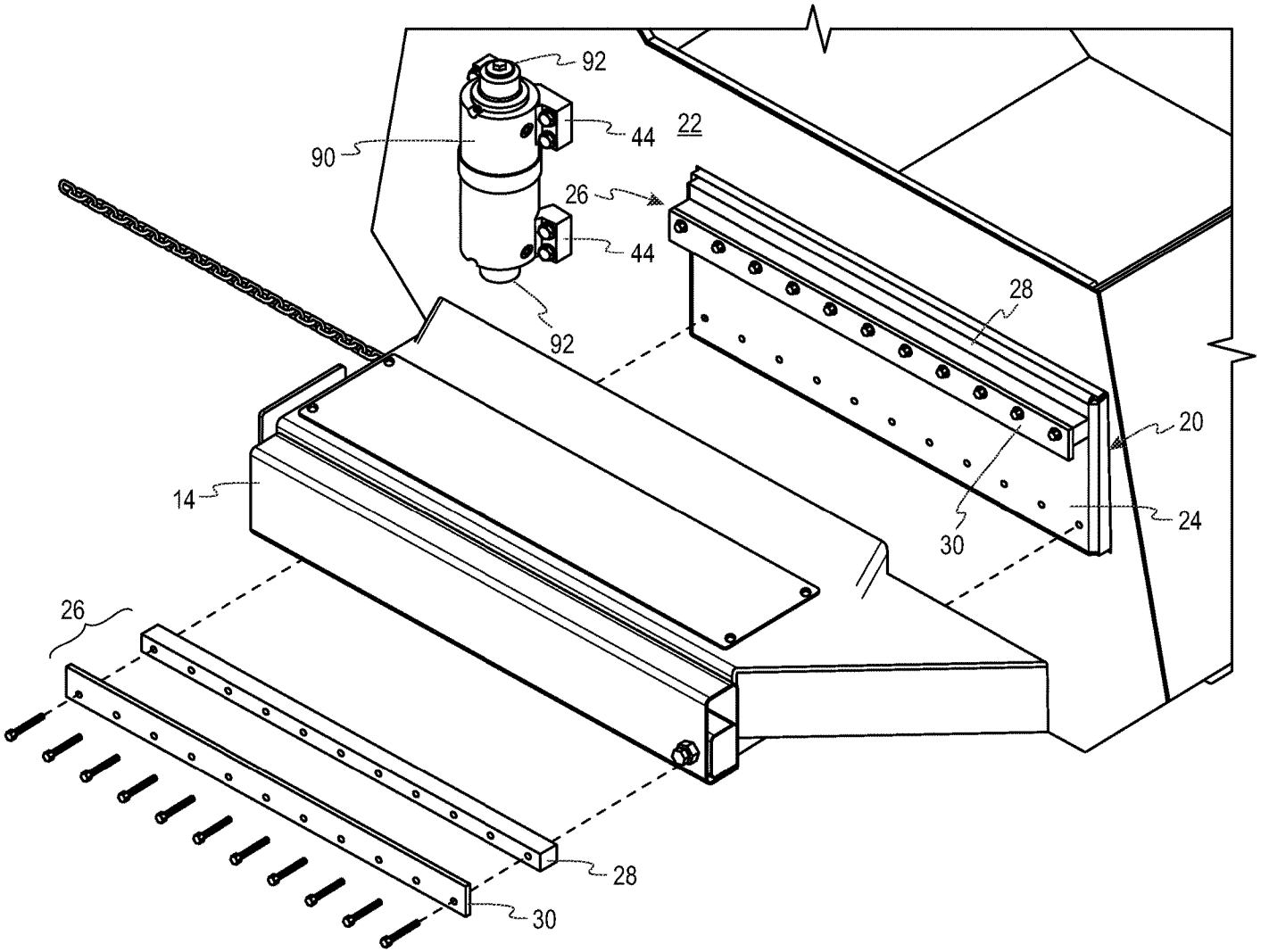
FIG. 9 is an exploded perspective view showing the elongated channel member secured to the side wall of the intermediate refuse collection container
Figure 10:
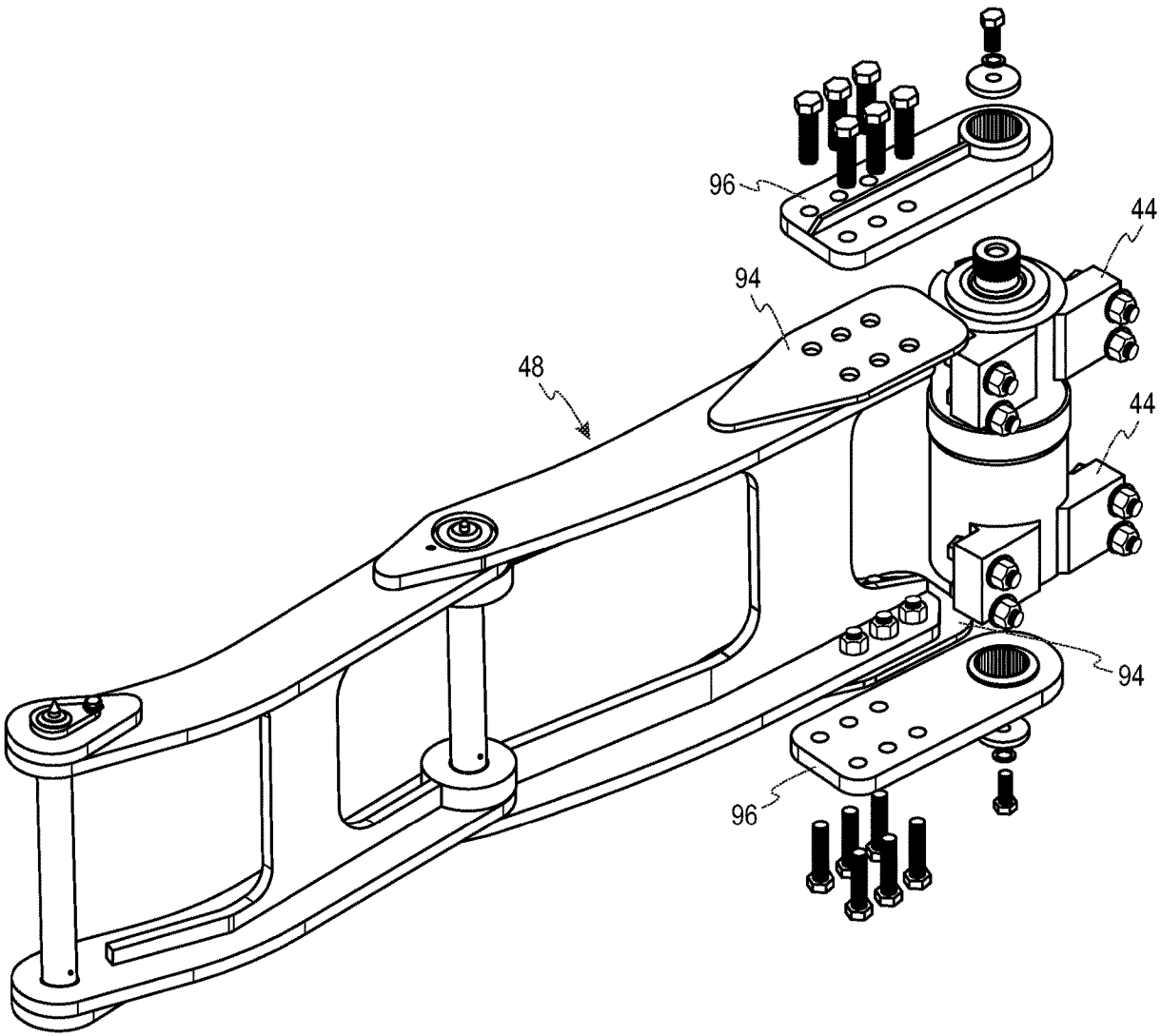
FIG. 10 is an enlarged perspective view of second scissor arm of the lifter assembly in combination with the bracket that is fixedly mounted to the side wall of the intermediate container and the rotary actuator that moves the scissors mechanism between the retracted and extended positions.

The container lifter 16 is adapted to move a container capturer or cart lifter assembly between a first retracted position, adjacent a wall of the intermediate container, and a second extended position, spaced away from the wall of the intermediate container to retrieve and return a residential collection cart. To this end, a scissors-type extension assembly 18 is provided. As best seen in FIG. 9, the extension assembly 18 includes an elongated channel member 20 that is secured to a side wall 22 of the intermediate container 10.

The elongated channel member 20 includes a base member 24 and a pair of elongated guide members 26 removably secured to the base 24 by a series of bolts, thus facilitating repair and replacement of the sliding surfaces. The guide members 25 each comprise an elongated low-friction slide block 28 and an elongated cap 30, with the cap 30 having a width sufficient to create a lip for maintaining a slidable mounting block 32 (described in greater detail below) in the channel member 20.

Figures 11A, 11B:
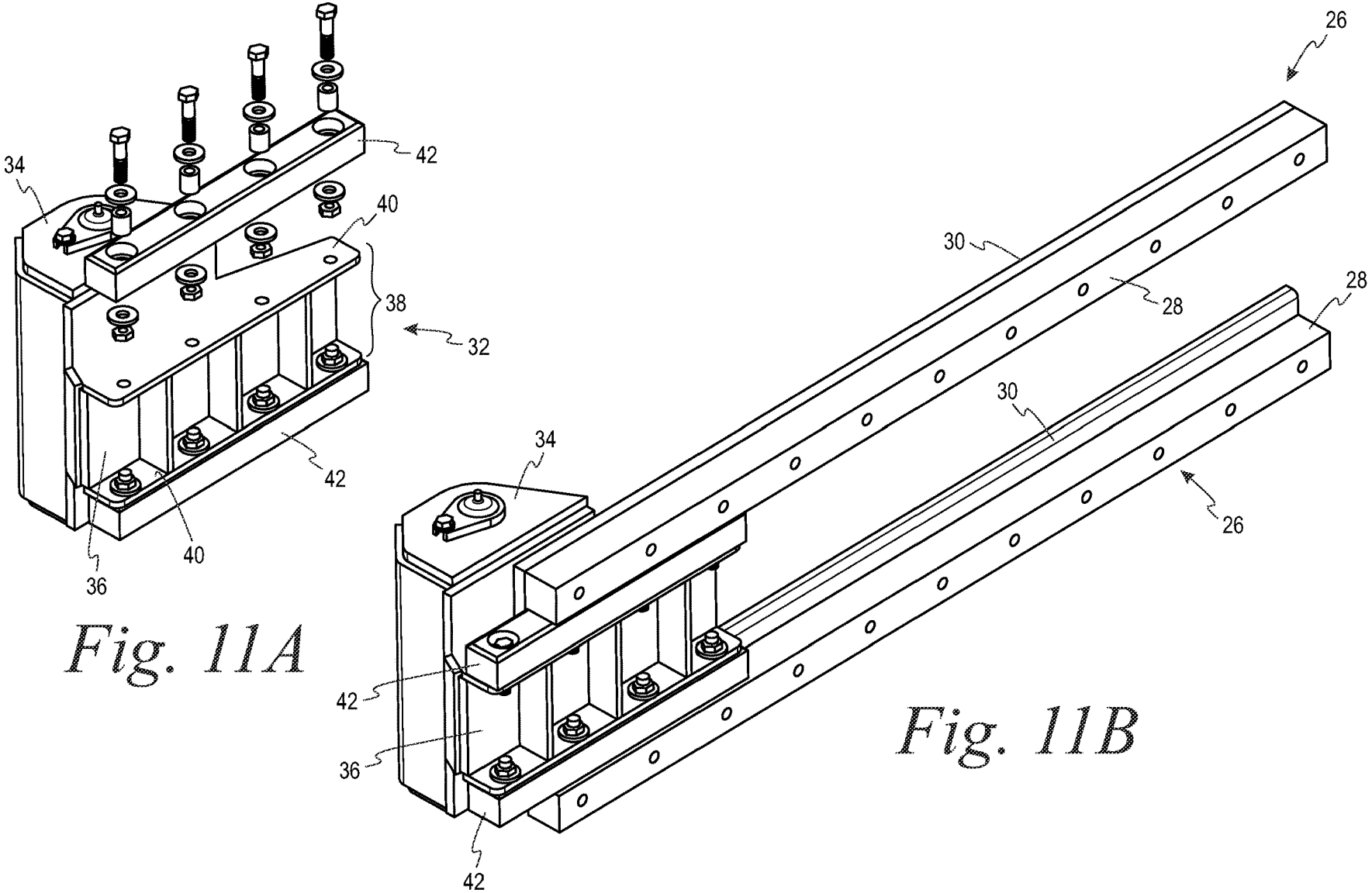

The slidable mounting block 32 is received in the channel member 20. As best seen in FIGS. 11*a* and 11*b*, the slidable block 32 includes a first member 34 (to which a scissor arm is pivotably mounted, as described below), and a second member 36 that is received in the channel member 20. The second member 36 comprises a framework 38 having opposed edges 40 to which a low-friction slide block 42 is removably secured, thus facilitating repair and replacement of the sliding surfaces. Thus, when the mounting block 32 is received in the channel 20, slide blocks 42 of the mounting block 32 are in face-to-face engagement with the slide blocks 28 of the channel.

A bracket 44 is fixedly mounted to the wall 22 of the intermediate container so that it is spaced laterally from the channel 20, with a scissor arm mounted for pivotable movement with respect thereto (also as described below).

The extension assembly 18 further comprises first, second, third and fourth scissor arms, designated 46, 48, 50 and 52, respectively, each having first and second ends. The first scissor arm 46 has its first end 46*a* pivotably secured to first member 34 of the slidable mounting block 32. The second scissor arm 48 has its first end 48*a* pivotably secured to the bracket 44, and the first and second scissor arms are pivotably connected to each other at a position intermediate that first and second ends of each. The first end 50*a* of the third scissor arm 50 is pivotably connected to the second end 46*b* of the first scissor arm 46 while the first end 52*a* of the fourth scissor arm 52 is pivotably secured to the second end 48*b* of the second scissor arm 48. The second ends 50*b*, 52*b* of the third and fourth scissor arms 50, 52 are pivotably connected to the cart lifter assembly 54, as described in greater detail below.

More specifically, the cart lifter assembly 54 comprises a frame 56 to which a cart grabber assembly 58, including a pair of grabber arms 60, is mounted. The grabber assembly 58 is movable relative to the frame 56 between a first upright position for storage and for retrieving and returning a residential refuse collection cart 12, and an inverted position, for emptying the contents of the residential refuse collection 12 cart into the intermediate container 10. The grabber arms 60 are also movable relative to the grabber assembly between an open (extended) position, in which the grabber arms 60 are generally coplanar so as to allow them to lie adjacent to the side wall 22 of the intermediate container 10 for storage and transportation, and a closed position, in which the grabber arms 60 would securely hold a residential refuse collection cart 12.

A first actuator 62 is provided for moving the grabber arms 60 between the open and closed positions, and a second actuator 64 is provided for moving the grabber assembly 58 between the upright and inverted positions. Various mechanisms for moving the grabber arms between the open and closed positions may be used, such as that disclosed in US 2011/0038697, referred to above, or in US 2005/0095097, which is incorporated herein by reference. In addition, other lifter mechanisms well known in the art for selectively engaging and releasing residential-size refuse collection carts also may be used, such as lifter mechanisms employing upper and lower hooks for engaging the bars on the collection cart. See. e.g., U.S. Pat. Nos. 6,929,441 and 4,773,812 which also are incorporated herein by reference.

Preferably, the second actuator 64 is mounted to the frame 56 and comprises a rotary actuator 62 having a rotatable shaft 66 extending from opposite ends thereof. The frame 56 further comprises opposed side members 68, each side member 68 having a generally circular aperture 70 through which the ends of the shaft 66 extend, with a slot 72 connecting the aperture 70 to an edge 74 of the side member 68. A removable plate member 76 is provided that is sized to substantially fill the slot 72, which is secured to the side member 68 by, e.g., bolts 78. The slot 72 facilitates assembly and service of the actuator 64, while the plate member 76 helps to form a box section to maintain the rigidity of the side members 68 of the frame 56.

Each grabber arm 60 preferably comprises a hub 80 for pivotably mounting the grabber arm 60 to the cart grabber assembly 58 and an elongated blade 82. The elongated blade 82 includes an inner, resilient gripping layer 84 secured to a rigid support 86. The rigid support 86 comprises a plurality of members 88*a*, 88*b* and 88*c*; preferably made of steel, layered one on top of the other, each secured on a first end to the hub 80 and being of increasing length. Preferably, the first member 88*a* directly supports the gripping layer 84 and has a length substantially equal to the length of the gripping layer 84, while the second member 88*b* is approximately two-thirds the length of the gripping layer 84, and a third member 88*c* is approximately one-third the length of the gripping layer 84. This provides the grabber arms 60 with a narrow configuration that is both structurally sound and permits the grabber arms 60 reach between closely-spaced collection carts.

In keeping with the disclosure, a third actuator 90 is provided for moving the scissor mechanism 18 between a first retracted position, in which the scissor arms lie in close proximity to the wall 22 of the intermediate container 10 for storage and for dumping a collection cart, and a second extended position spaced laterally from the wall 22 of the intermediate container for retrieving and returning a collection cart. The third actuator 90 is a rotary actuator that is secured to the fixed mounting bracket 44. The rotary actuator 90 includes a rotatable shaft 92 that extends from both ends of the actuator 90, to which the first end 48*a* of the second scissor arm 48 is removably secured in order to facilitate removal of the actuator 90 for servicing. Preferably, the second scissor arm comprises a reinforcement plate 94 welded to the second scissor arm 48 at its first end 48*a*. The first end 48*a* of the second scissor arm 48 is then secured to the shaft 92 of the third actuator 90 by an adapter plate 96 removably attached to the reinforcement plate 94.

The rotary actuator 90 provides for smooth and even movement of the scissor mechanism between the retracted and extended positions, and holds the scissors mechanism securely when in the retracted position, in contrast to the linear hydraulic actuator used by the prior art for moving the scissors mechanism. In addition, use of the hydraulic actuator results in a significant reduction of the flow rate of hydraulic fluid required to extending and retracting the scissors mechanism, which saves fuel used for operating the hydraulic system, reduces heat build-up in the system, and reduces wear and tear.

Figure 5:
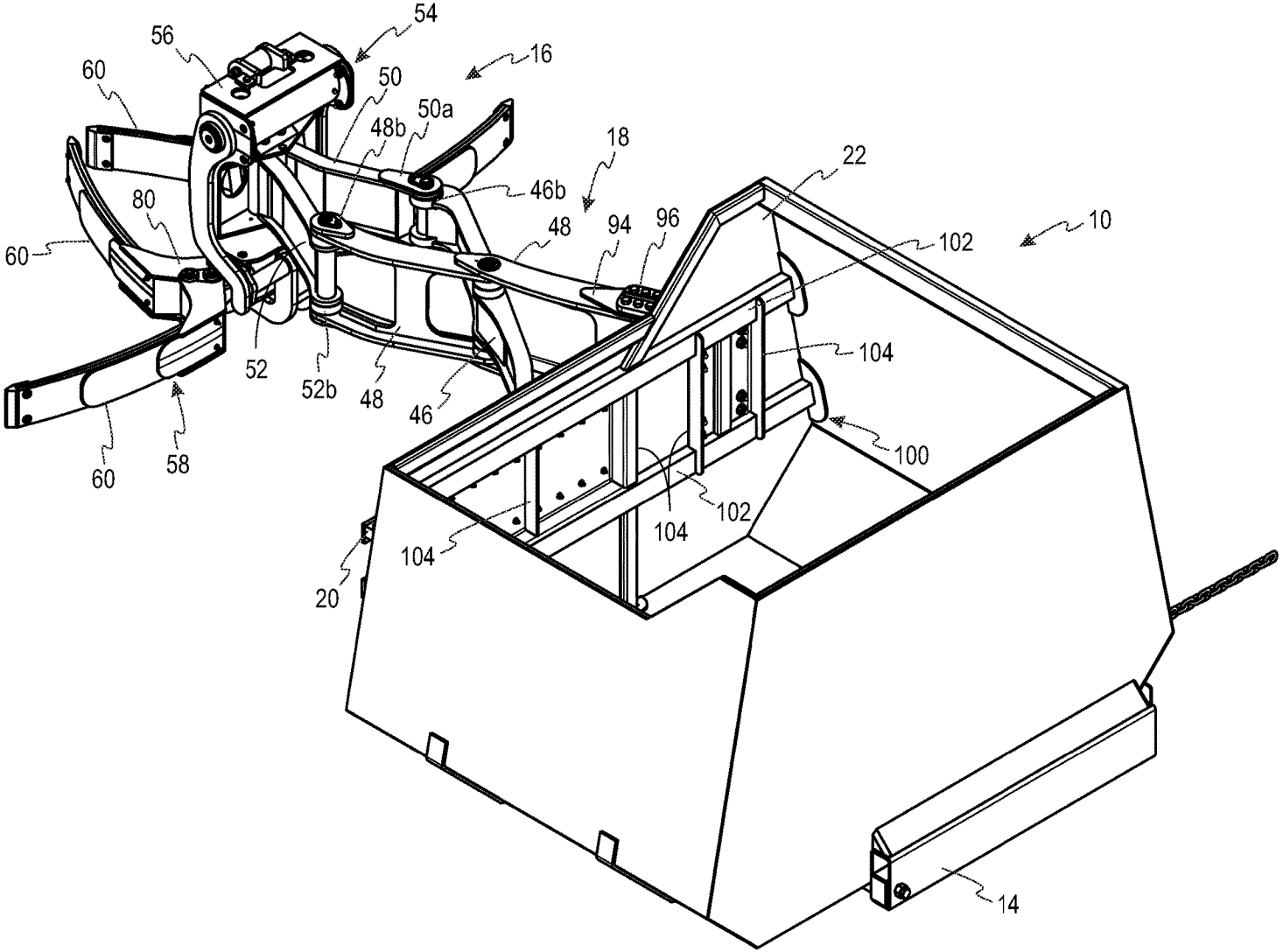
FIG. 5 is a perspective view similar to FIG. 4 taken from the reverse perspective.
Figure 6:
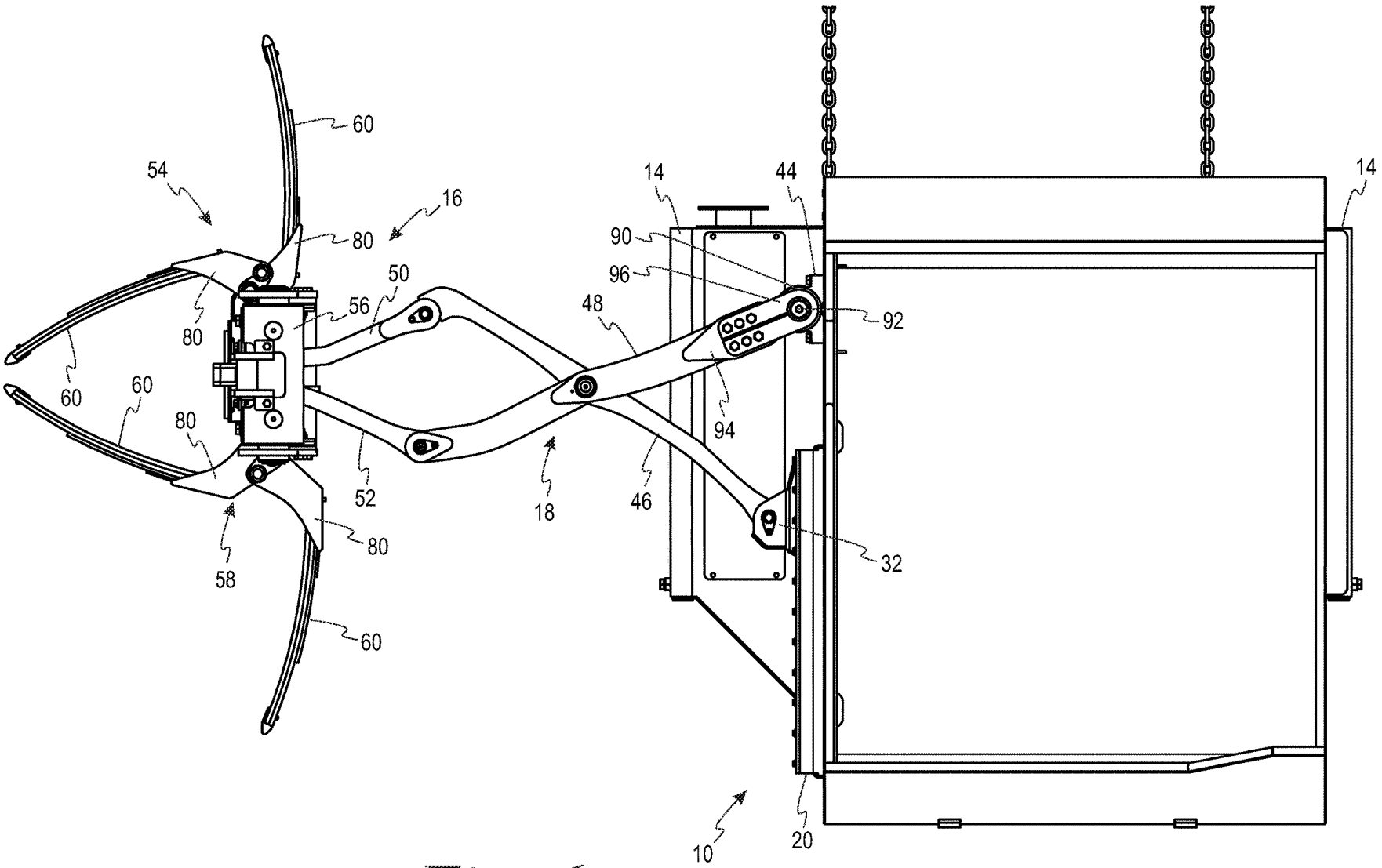
FIG. 6 is a top view of the scissors-type lifter assembly according to the present disclosure mounted to a side wall of an intermediate refuse collection container with the scissors mechanism in the extended position, the cart lifter in the upright position, and the grabber arms in the open and closed positions.
Figure 7:
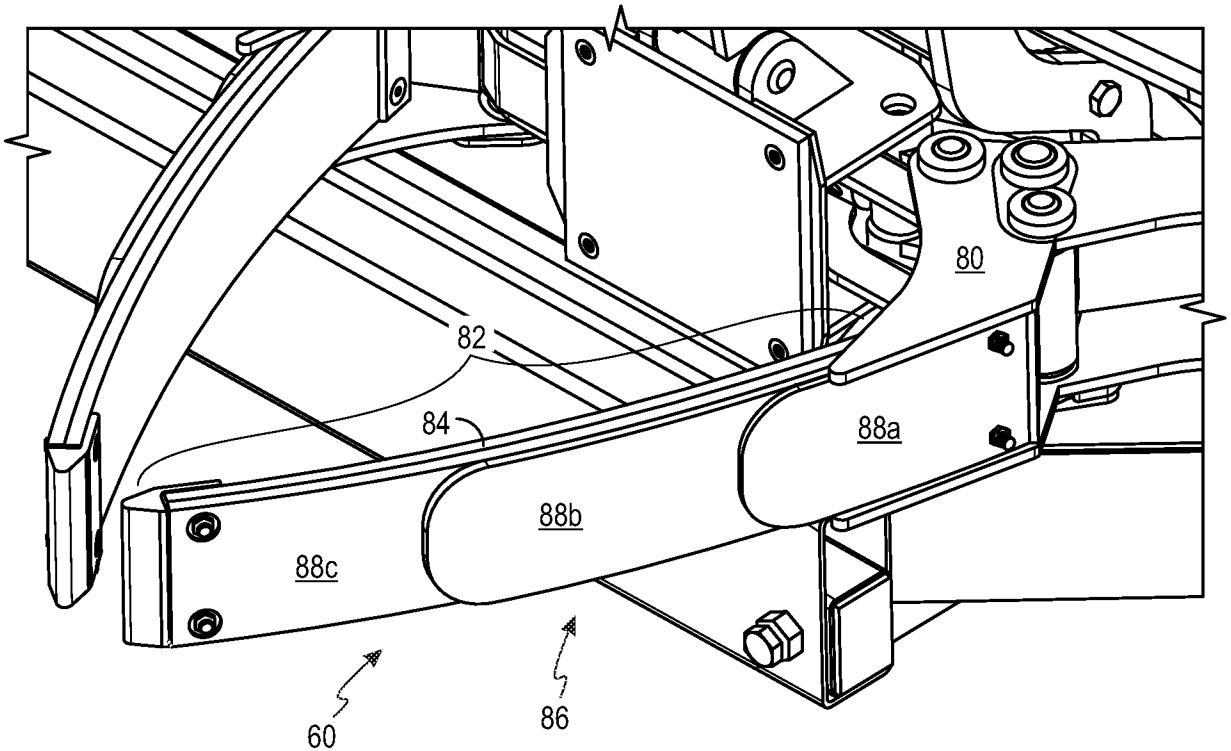
FIG. 7 is an enlarged perspective view of the grabber arms of the cart lifter that is preferably used in combination with the scissors-type lifter assembly of the present disclosure.
Figures 8A, 8B:
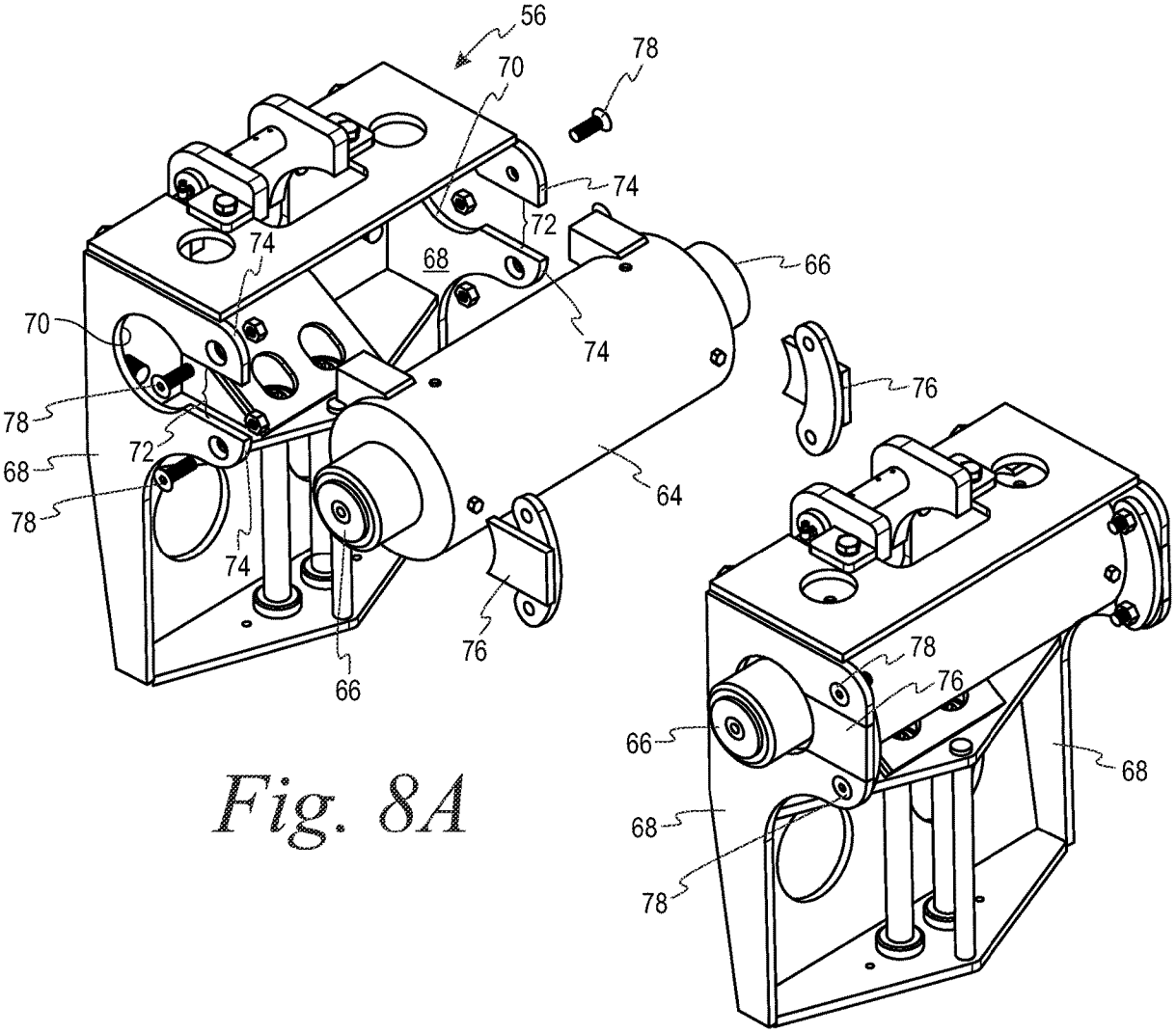

Use of a rotary actuator for operating the scissors mechanism may require reinforcement of the intermediate container to provide for a rigid and stable connection with the intermediate container. With reference to FIG. 5, there can be seen a reinforcing structure, generally designated 100, secured to the interior of the container side wall to which the scissors assembly is mounted. The reinforcing structure 100 includes two, elongated members 102 that extend between the front and rear walls of the intermediate container and are spaced apart a distance generally commensurate with the height of the channel structure 20. The elongated members 102 may be U-shaped channels secured to the side wall by, e.g. welding, and a plurality of cross members 104 may be provided that are secured to both the elongated members 102 and the side wall of the container. Such a reinforcement structure provides several advantages. By keeping the reinforcement structures inside the intermediate container, a smooth, clean appearance is maintained for the outside. Also, should the reinforcement structure rust, any rust streaks will be on the interior of the container.

A description of a typical sequence of operation of the container lifter assembly follows. In use, in the normal pick-up mode, the intermediate refuse collection container is carried on lifter forks in front of the collection vehicle cab, or otherwise affixed to the lift arms of the collection vehicle. With the lifter assembly in the retracted position, the vehicle stops so that the intermediate refuse receptacle is spaced laterally from a residential refuse collection cart. The actuator 90 is activated, moving the first ends 46*a*, 48*a* of the first and second scissor arms 46, 48 toward each other so that the second ends 50*b*, 52*b* of the third and fourth scissor arms 50, 52 move away from the first position adjacent to the lateral side wall of the front-load refuse receptacle to the second position extending toward a residential refuse collection cart. Actuator 62 is then activated so that the grabber arms 60 capture the residential refuse collection cart. Then, the actuator 90 is activated again to draw the scissor arms 46, 48, 50 and 52 and the associated cart grabber 58, along with the residential refuse collection cart, back toward the intermediate, front-load refuse receptacle.

The actuator 64 is then activated to invert the cart grabber 58 with respect to the side wall of the collection container, thus moving the residential collection cart 12 to an inverted dumping position to empty the contents of the cart into the intermediate collection container. The steps are then performed in reverse order to return the residential collection cart to its original position. After the cart is released, the lifter assembly is retracted to its first position adjacent the side wall of the collection container.

Thus, a lifter assembly for use with an intermediate refuse collection container has been disclosed having various advantages and features. While the lifter assembly has been disclosed in terms of certain preferred embodiments, there is no intent to limit the invention to the same. Instead, the invention is defined by the following claims.

The invention claimed is:

1. A lifter assembly for emptying a refuse collection cart into a container comprising:

a) a cart lifter comprising a frame, a cart grabber pivotably mounted to the frame, opposed grabber arms pivotably mounted to the cart grabber, a first actuator mounted to the cart grabber for moving the grabber arms relative to the cart grabber between a first open position and a second closed position, and a second actuator for moving the cart grabber relative to the frame between a first upright position and a second inverted position; and b) a scissors extension assembly for moving the lifter between a first retracted position adjacent a wall of the container and a second extended position spaced away from the wall, the scissors extension assembly further comprising: i) an elongated channel member connected to the wall; ii) a mounting element slidably received in the elongated channel member; iii) a first scissor arm having first and second ends, the first end being pivotably connected to the mounting element; iv) a rotary actuator mounted to the wall and spaced from the elongated channel member; v) a second scissor arm having first and second ends, the first end being connected to a rotatable shaft extending from at least one end of the rotary actuator for pivotable movement relative to the wall, an intermediate portion of the first scissor arm being pivotably connected to an intermediate portion of the second pivot arm; vi) a third scissor arm having first and second ends, the first end being pivotably connected to the second end of the first scissor arm and the second end being pivotably connected to the frame of the lifter; vii) a fourth scissor arm having first and second ends, the first end being pivotably connected to the second end of the second scissor arm and the second end being pivotably connected to the frame of the lifter; and viii) the rotary actuator rotatable shaft connected to the first end of the second scissor arm for moving the lifter relative to the wall between the first retracted position and the second extended position.

2. The lifter assembly of claim 1 wherein each grabber arm further comprises a hub for pivotably mounting the grabber arm to the cart grabber.

3. The lifter assembly of claim 1 wherein each grabber arm further comprises an elongated blade.

4. The lifter assembly of claim 3 wherein each elongated blade further comprises an inner, resilient gripping layer connected to a rigid support.

5. The lifter assembly of claim 4 wherein each rigid support comprises a plurality of layered connected members.

6. The lifter assembly of claim 5 wherein each of the plurality of layers is connected at a first end to the hub and being of increasing length, with the member directly supporting the gripping layer having a length substantially equal to the length of the gripping layer.

7. The lifter assembly of claim 4 wherein each rigid support comprises a first member having a length approximately one-third the length of the gripping layer, a second member approximately two-thirds the length of the gripping layer, and a third member approximately the same length as the gripping layer.

8. The lifter assembly of claim 1, wherein the second actuator is connected to the frame and comprises a rotary actuator having a rotatable shaft extending from opposite ends thereof.

9. The lifter assembly of claim 8 wherein the frame further comprises opposed side members, each side member having a generally circular aperture through which the ends of the shaft of the second actuator extend.

10. The lifter assembly of claim 9 wherein a slot connects the aperture to an edge of the frame, and a removable plate member is sized to substantially fill the slot between the end of the shaft of the second actuator and the edge of the frame and is connected to the side member.

11. The lifter assembly of claim 1 wherein the elongated channel further comprises a base member, and first and second elongated guide members.

12. The lifter assembly of claim 11 wherein the first and second elongated guide members are removably connected with the base member to the wall.

13. The lifter assembly of claim 11 wherein each guide member further comprises an elongated low-friction slide element.

14. The lifter assembly of claim 13 wherein each guide member further comprises an elongated cap, the cap having a width relative to the slide element sufficient to create a lip for maintaining the mounting element slidably received in the elongated channel member.

15. The lifter assembly of claim 1 wherein the first end of the second scissor arm is removably connected to the shaft of the rotary actuator connected to the wall.

16. The lifter assembly of claim 15 wherein the second scissor arm comprises a reinforcement plate connected to the first end of the second scissor.

17. The lifter assembly of claim 16 wherein an adapter plate is removably connected to the reinforcement plate.

18. The lifter assembly of claim 1 wherein the slidable mounting element comprises a first member to which the first end of the first scissor arm is pivotably connected and a second member slidably received in the channel member.

19. The lifter assembly of claim 18 wherein the second member of the slidable mounting element comprises a framework having opposed edges.

20. The lifter assembly of claim 19 wherein each of the opposed edges of the framework has a low friction slide removably connected thereto.

* * * * *